US009328536B2

(12) United States Patent
Shute et al.

(10) Patent No.: US 9,328,536 B2
(45) Date of Patent: May 3, 2016

(54) MULTIPURPOSE SECURITY DEVICE AND ASSOCIATED METHODS

(75) Inventors: Matthew R. Shute, Huntersville, NC (US); Mark A. Ezzo, Matthews, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 161 days.

(21) Appl. No.: 13/525,769

(22) Filed: Jun. 18, 2012

(65) Prior Publication Data

US 2012/0318027 A1 Dec. 20, 2012

Related U.S. Application Data

(60) Provisional application No. 61/498,924, filed on Jun. 20, 2011.

(51) Int. Cl.
*E05B 73/00* (2006.01)

(52) U.S. Cl.
CPC ..... *E05B 73/0017* (2013.01); *E05B 73/0029* (2013.01); *E05B 73/0035* (2013.01); *Y10T 70/402* (2015.04)

(58) Field of Classification Search
CPC . E05B 73/00; E05B 73/0005; E05B 73/0011; E05B 73/0017; E05B 73/0023; E05B 73/0029; E05B 73/0082
USPC ..... 70/57, 57.1, 58
See application file for complete search history.

(56) References Cited

U.S. PATENT DOCUMENTS

| | | | | |
|---|---|---|---|---|
| 3,664,164 | A | 5/1972 | Zaidener | |
| 4,896,517 | A * | 1/1990 | Ling | 70/18 |
| 5,156,028 | A * | 10/1992 | Jiang | 70/30 |
| 5,794,464 | A * | 8/1998 | Yeager et al. | 70/57 |
| 6,237,375 | B1 * | 5/2001 | Wymer | 70/58 |
| 6,920,769 | B2 | 7/2005 | Huehner | |
| 7,251,966 | B2 * | 8/2007 | Fawcett et al. | 70/57 |
| 7,451,627 | B2 | 11/2008 | Horngren et al. | |
| 7,474,209 | B2 | 1/2009 | Marsilio et al. | |
| 7,484,389 | B2 | 2/2009 | Sedon et al. | |
| 7,497,101 | B2 * | 3/2009 | Fawcett et al. | 70/57 |
| 7,685,850 | B2 | 3/2010 | Nilsson | |
| 7,961,100 | B2 | 6/2011 | Wyatt, Jr. et al. | |
| 7,984,629 | B2 * | 7/2011 | Xiaobin | 70/57 |
| 8,890,689 | B2 * | 11/2014 | Ezzo | E05B 73/0017 340/539.11 |
| 2005/0223756 | A1 * | 10/2005 | Ling | E05B 73/0005 70/30 |
| 2008/0236209 | A1 * | 10/2008 | Conti et al. | 70/57.1 |
| 2009/0223260 | A1 * | 9/2009 | Conti et al. | 70/57.1 |
| 2010/0090830 | A1 | 4/2010 | Conti et al. | |
| 2010/0101283 | A1 * | 4/2010 | Xiaobin | 70/14 |
| 2010/0139336 | A1 * | 6/2010 | Necchi | 70/57.1 |
| 2011/0308283 | A1 * | 12/2011 | Nilsson | 70/57.1 |

FOREIGN PATENT DOCUMENTS

| | | |
|---|---|---|
| WO | 2011053985 | 5/2011 |

* cited by examiner

*Primary Examiner* — Christopher Boswell
(74) *Attorney, Agent, or Firm* — Nelson Mullins Riley & Scarborough LLP

(57) ABSTRACT

A security device for protecting a merchandise item against theft typically includes a pair of clamping members, a cable extending between the clamping members, and a tightening mechanism for tightening the cable to cause the clamping members to move toward one another and clamp onto the merchandise item. One of the clamping members typically serves as a housing containing the tightening mechanism, which may include a spool, a lock slide for releasably securing the spool and a locking mechanism for releasably securing the lock slide. The locking mechanism may be unlocked with a magnetic key. The security device is typically configured to set off an alarm upon tampering or attempted removal of the item and security device from a store.

20 Claims, 12 Drawing Sheets

MULTIPURPOSE SECURITY DEVICE AND ASSOCIATED METHODS

CROSS REFERENCE TO RELATED APPLICATION

This application claims priority from U.S. Provisional Application Ser. No. 61/498,924, filed Jun. 20, 2011; the disclosure of which is incorporated herein by reference.

TECHNICAL FIELD

The invention relates to a security device. More particularly, the present invention relates to a security device that locks onto a variety of merchandise items. Specifically, the invention relates to a security device that can be locked onto a security device with the push of a single button locked position and that when the button is moved to an unlocked position the security device can remain in an unlocked configuration.

BACKGROUND OF THE INVENTION

Retail stores have a difficult time protecting merchandise items such as eyeglasses, boxes containing various expensive merchandise, electronic items and other similarly structured packages, as well as protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Another approach to protect items is to use custom security protection devices for different types of merchandise items. For example, "pin tags" can be used for merchandise items where a pin can be punched through the merchandise item and a secure alarm box can be attached to the pin on the other side of the merchandise item as describe in U.S. Pat. No. 6,920,769. Alternatively, "cable lock" anti-theft protection devices have a cable that can be looped through a merchandise item and then secured into an alarm housing as discussed in U.S. Pat. No. 7,474,209. Another type of protection device is a clear plastic box or "safer" into which the merchandise item can placed and the lid of the box locked and alarmed as described in U.S. Pat. No. 7,484,389. It is not always practical to have a variety of security devices for different types of merchandise. Additionally, traditional security devices have a difficult time securing objects with long thin surface that provide little friction (eyewear, small tool handles) without damaging those surfaces and without sliding or being easily pulled off those surfaces. Therefore, a need exists for a single security device with a robust locking mechanism that can be placed on a variety of merchandise items.

SUMMARY

The present invention provides a security device comprising a housing; a cable; a spool which is within the housing and rotatable in a winding direction for winding the cable onto the spool and an unwinding direction for unwinding the cable from the spool; a first engaging member which is rotatable with the spool; a lock slide which is movable between an engaged position and a disengaged position and comprises a lock slide body, a second engaging member and a spring which biases the second engaging member toward the engaging position; wherein in the engaged position the second engaging member engages the first engaging member to prevent the spool from rotating in the unwinding direction, and in the disengaged position the second engaging member is disengaged from the first engaging member to allow the spool to rotate in the unwinding direction; and a locking mechanism having a locked position in which the locking mechanism prevents movement of the lock slide from the engaged position to the disengaged position and an unlocked position which allows the lock slide to move from the engaged position to the disengaged position.

The present invention also provides a security device comprising a cable; a rotatable spool; first and second clamping members which define therebetween a merchandise item receiving space and which move toward one another in response to the cable winding onto the spool so that the first and second clamping members are configured to clamp therebetween a portion of the merchandise item; and an EAS tag.

The present invention further provides a method comprising the steps of winding a cable onto a spool of a security tag to cause first and second clamping members of the tag to clamp therebetween a merchandise item; and providing an alarm which is activated upon movement of the security tag from a non-alarming zone to an alarming zone or upon tampering with the security tag.

BRIEF DESCRIPTION OF SEVERAL VIEWS OF THE DRAWINGS

One or more preferred embodiments that illustrate the best mode(s) are set forth in the drawings and in the following description.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE INVENTION

Figure 1:
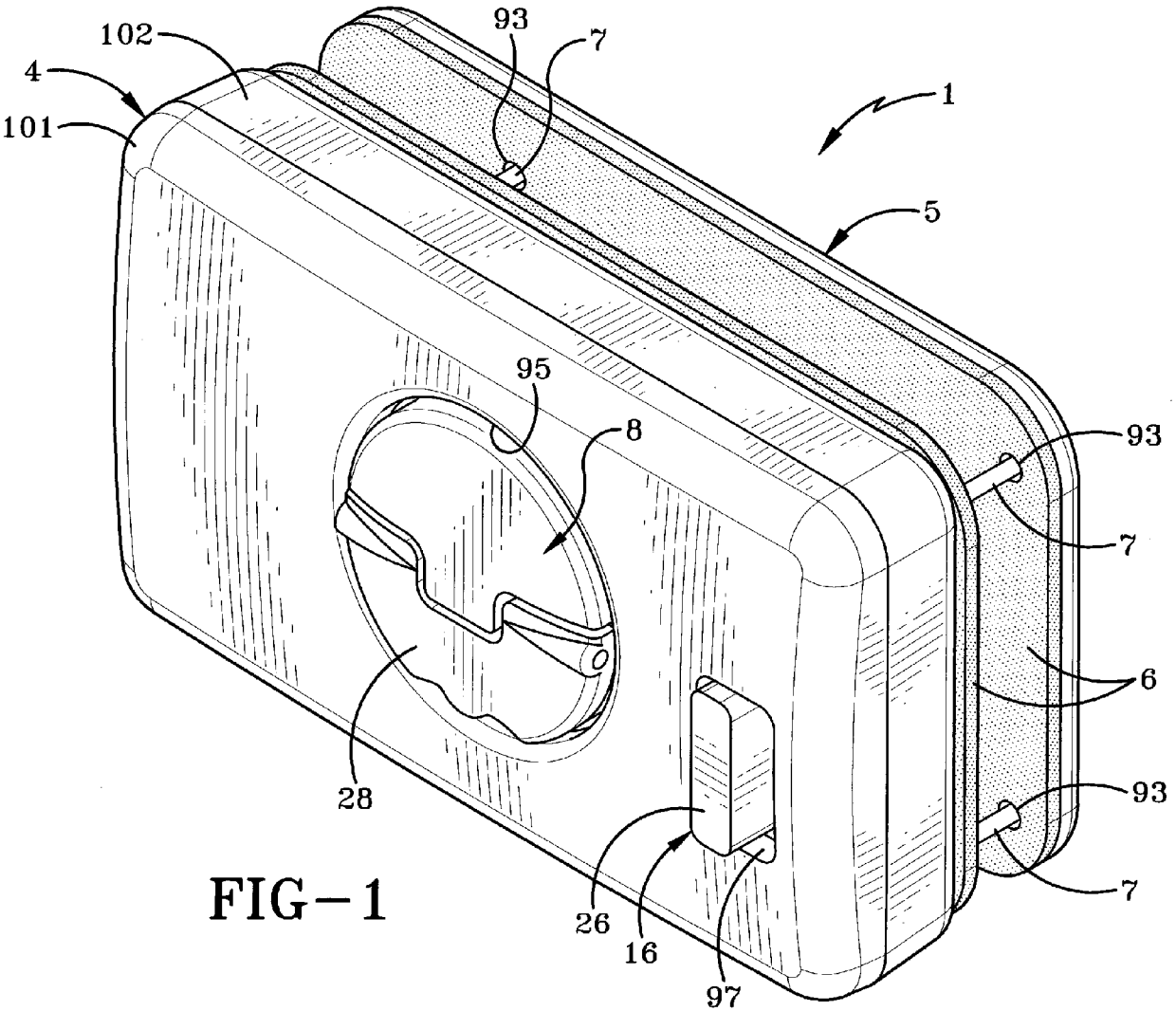
FIG. 1 is a perspective view of the preferred embodiment of a multipurpose security device.

The security device or tag 1 of the present invention is indicated generally at 1 in FIG. 1 and includes two main components, a main housing 4 and a crossover device 5 which serve as clamping members for clamping therebetween an item of merchandise to secure device 1 to the item. Device or tag 1 further includes front and rear compressible pads 6, a typically metal flexible lanyard or cable 7, a rigid spool 8, an electronic article surveillance (EAS) tag 10, a ratchet and locking mechanism 12 comprising a lock slide 14, and a locking mechanism 15.

In the exemplary embodiment, the main housing 4 and crossover device 5 are generally rectangular in shape and can, for instance, be sized to a substantially rectangular box shape of about 15 mm×46 mm×26 mm. Device 1 is configured to be placed on and tightened about a wide variety of merchandise items such as eyewear, boxes, electronic devices and the like. The surface area between this main body 4 and crossover device 5 is of sufficient area to spread out compression forces on the merchandise item applied by clamping members 4 and 5 when device 1 is clamped onto and locked to the merchandise item. Unlike conventional direct clamping approaches, security device 1 is well suited for securing objects with long thin surfaces that provide little friction (eyewear, small tool handles, etc.) without damaging those surfaces and without sliding or being easily pulled off those surfaces. Device 1 includes a cable assembly which is adjustable and allows members 4 and 5 to conform to the secured surfaces of the merchandise item, allowing for different widths, thickness and shape contours of various merchandise items to be accommodated with the same security device 1. Housing 4 is a rigid structure typically formed of a rigid plastic material.

Housing 4 includes a generally rectangular front half or housing member 101 and a generally rectangular rear half or housing member 102 which are typically injection molded pieces and rigidly secured to one another along respective outer perimeters thereof to define therewithin an interior chamber in which various components are disposed. Front housing member 101 includes a substantially flat rectangular front wall, left and right sidewalls extending rearwardly respectively from the left and right edges of the front wall, and top and bottom walls extending rearwardly respectively from the top and bottom edges of the front wall. The front wall of the front housing member defines a central circular through opening 95 and a smaller rectangular through opening 97 spaced to the right of the circular opening. Each of through openings 95, 97 extends from the front surface to the back surface of the front wall of housing 4.

Rear housing member 102 includes a substantially flat rectangular back wall, left and right sidewalls extending forward respectively from the left and right edges of the back wall, and top and bottom walls extending forward respectively from the top and bottom edges of the back wall. The back wall of the rear housing member defines four cable-receiving circular through holes 93 which extend from the front surface to the back surface of the back wall and which are respectively generally adjacent the four corners of the back wall of the housing. These holes 93 align respectively with four respective cable-receiving through holes 93 formed similarly in pads 6 and clamping member 5 which likewise extend from the respective front surfaces to the respective rear surfaces thereof. Each of clamping member 4, clamping member 5, front pad 6 and rear pad 6 thus includes respective upper left holes 93, upper right holes 93, lower left holes 93 and lower right holes 93.

Rear housing member 102 includes several rigid guides 103 which are rigidly secured to the back wall and extend forward therefrom into the interior chamber of the housing. In particular, a left lower guide 103A is disposed in the lower left corner of the interior chamber and is rigidly secured to the left sidewall and extends rightward therefrom; a left intermediate guide 103B is in the lower half and left half of the interior chamber, is spaced upwardly from the bottom wall of the rear housing member and is generally adjacent, above and to the right of left lower guide 103A; a right lower guide 103C is disposed in the lower right corner of the interior chamber and is rigidly secured to the right sidewall and extends leftward therefrom; and a right upper guide 103D is disposed in the upper half and right half of the interior chamber and is rigidly secured to the right sidewall and extends leftward therefrom. Guide 103A has a horizontal upwardly facing top slide surface 105A; guide 103B has a horizontal downwardly facing bottom slide surface 105B; guide 103C has a horizontal upwardly facing top slide surface 105C; and guide 103D has a horizontal downwardly facing top slide surface 105D which directly above and faces slide surface 105C of guide 103C. Lower right guide 103C includes a vertical wall and a horizontal which together with the lower end portion of the right sidewall and the right end portion of the bottom wall portion of the rear housing member defines an anchor-receiving space 109A in the lower right corner of the rear housing member. A cylindrical collar 107 is rigidly secured to and extends forward from the front of the back wall of the housing into the interior chamber and defines another anchor-receiving space 109B generally adjacent the upper left corner of the rear housing member.

A central circular post 104A is rigidly secured to and extends forward from about the center of the back wall of the back housing member into the interior chamber and short distance and terminates at a vertical flat forward facing circular front surface. A circular ring 104B is rigidly secured to and extends forward from the back wall of the back housing member into the interior chamber a short distance and terminates at a vertical flat forward facing circular annular front surface which is substantially coplanar with the front surface of post 104A. Ring 104B encircles or surrounds post 104A and has a circular inner surface which is concentric with the circular outer surface of post 104A whereby the circular inner surface and circular outer surface define therebetween a circular annular cavity or space 113 having a front entrance opening and the back of which is defined by the front surface of the back wall of the back housing member.

Crossover device or rear clamping member 5 is substantially flat and may be formed from material that allows it to at least partially twist to conform to the shape of a merchandise item it is attached to. For example, the crossover device 5 is typically formed of a substantially rigid resilient plastic yet can be thinner in the middle or sufficiently thin overall so that device 5 provides sufficient flexibility that device 5 can twist or bend partly around the shape of a secured merchandise item so that device 1 more securely grips that item.

Thin compressible pads 6 which are typically formed of rubber or another elastomer with a hardness factor typically on the order of about Shore A30 or other types of material with similar hardness factors can be placed on facing sides of the main housing 4 and crossover device 5 so that the typically thin flat pieces 6 of padding face one another and engage opposed sides of the merchandise item to increase the grip of security device 1 on the merchandise item while also preventing device 1 from scratching that item. Pads 6 may be formed, for example, of a foam or non-foam material which is substantially softer than the material of which clamping members 4 and 5 are formed.

Figure 8:
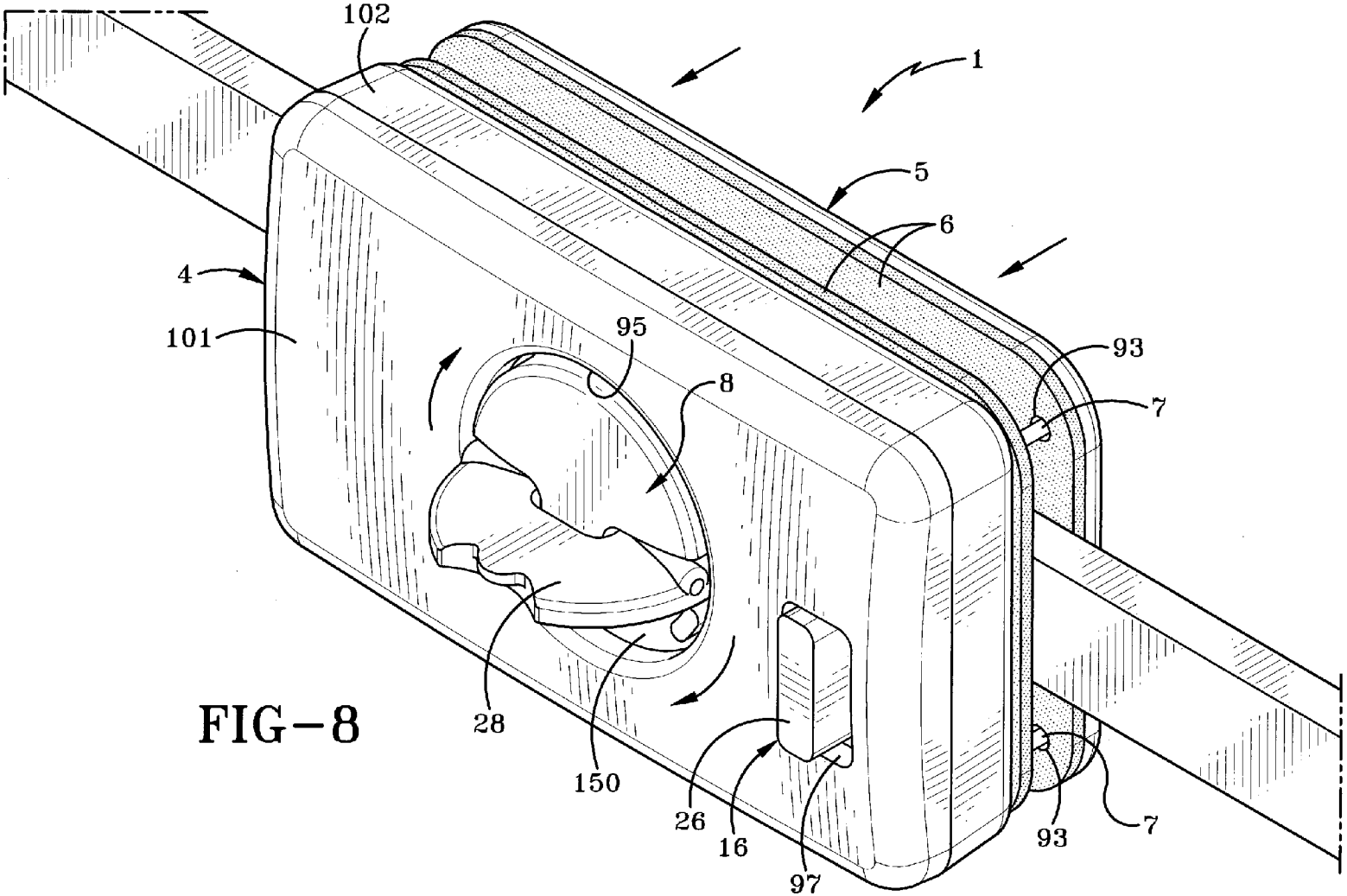
FIG. 8 is a perspective view similar to FIG. 1 showing security device being attached to a merchandise item (e.g., eyeglasses).

Compressible pads 6 are generally rectangular as viewed from the front and are typically of substantially the same shape and size of the flat rear surface of front clamping member 4 and the flat front surface of rear clamping member 5. Thus, the front surface of front pad 6 engages the rear surface of front clamping member 4 so that front pad 6 typically substantially covers the entire rear surface of front clamping member 4. Likewise, the rear surface of rear pad 6 engages the front surface of rear clamping member 5 so that rear pad 6 typically substantially covers the entire front surface of rear clamping member 4. Pads 6 are disposed between the clamping members 4 and 5 and define therebetween a merchandise receiving space for receiving at least a portion of a merchandise item, typically with the remainder of the item extending outwardly beyond the top, bottom or side edges of clamping members 4 and 5 and of pads 6, as shown in FIG. 8.

Cable 7 passes through the crossover device or clamping member 5 and is wound onto spool 8 in housing 4. Typically, there are two metal crimps or anchors 9 rigidly attached to each end of cable 7, and cable 7 passes through the center of the spool 8 allowing the cable 7 to be wound onto and unwound from the spool 8 respectively when spool 8 is rotated in cable-tightening and cable-loosening directions. Alternatively, two cables 7 can be used with a metal crimp 9 attached to one end of each cable 7 and the other end of each cable physically attached to the spool 8.

In the exemplary embodiment, one of anchors 9 is permanently disposed in anchor-receiving space 109A and the other anchor 9 is permanently disposed in anchor-receiving space 109B whereby each end of cable 9 is permanently disposed within the interior chamber of housing 4. Cable 7 extends from the upper left anchor 9 out of housing 4 through the upper left hole 93 and then through the respective upper left holes 93 in front and rear pads 6 and rear clamping member 5, then back through the upper right holes 93 in rear clamping member 5 and in front and rear pads 6 and housing 4 back into the interior chamber of housing 4 and onto and/or through spool 8. From spool 8, cable 7 extends out of housing 4 through the lower left hole 93 and then through the respective lower left holes 93 in front and rear pads 6 and rear clamping member 5, then back through the lower right holes 93 in rear clamping member 5 and in front and rear pads 6 and housing 4 back into the interior chamber of housing 4 to the lower right anchor 9. Thus, no portion of cable 7 which extends into housing or clamping member 4 from the upper left hole 93 or from the lower left hole 93 engages the spool. Anchors 9 and the corresponding ends of cable 7 are thus secured to housing 4 at locations which are spaced from spool 8.

Figures 2, 2A, 2B, 2C:
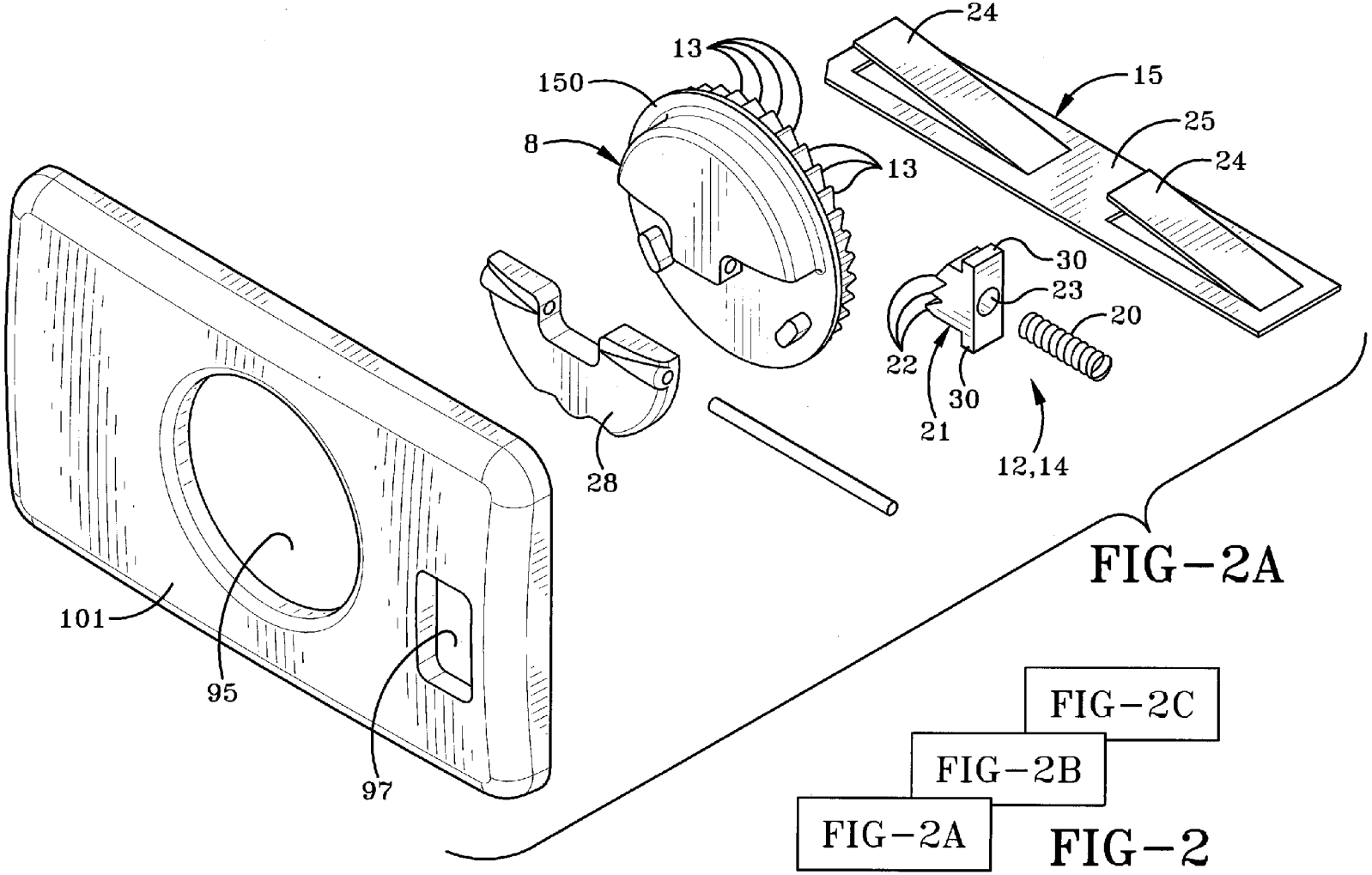
FIG. 2 is a view showing the relation of FIGS. 2A, 2B and 2C.
FIG. 2A is an exploded perspective view of the front housing member of the housing and other components of the security device.
FIG. 2B is an exploded perspective view of the rear housing member and other components of the security device.
FIG. 2C is an exploded perspective view of the cross-over device or rear clamping member and the pads of the security device.
Figure 2B:
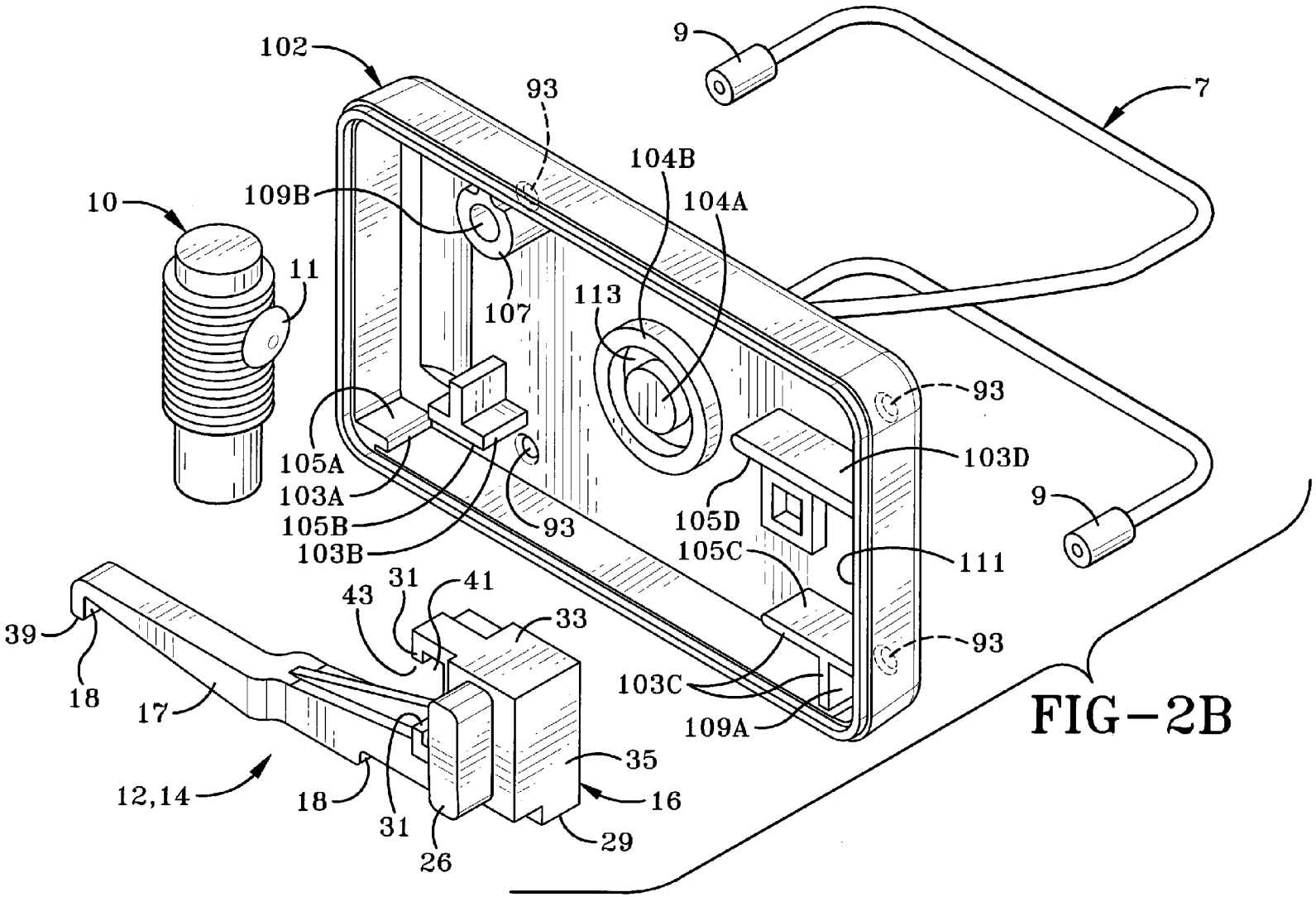
Figure 2C:
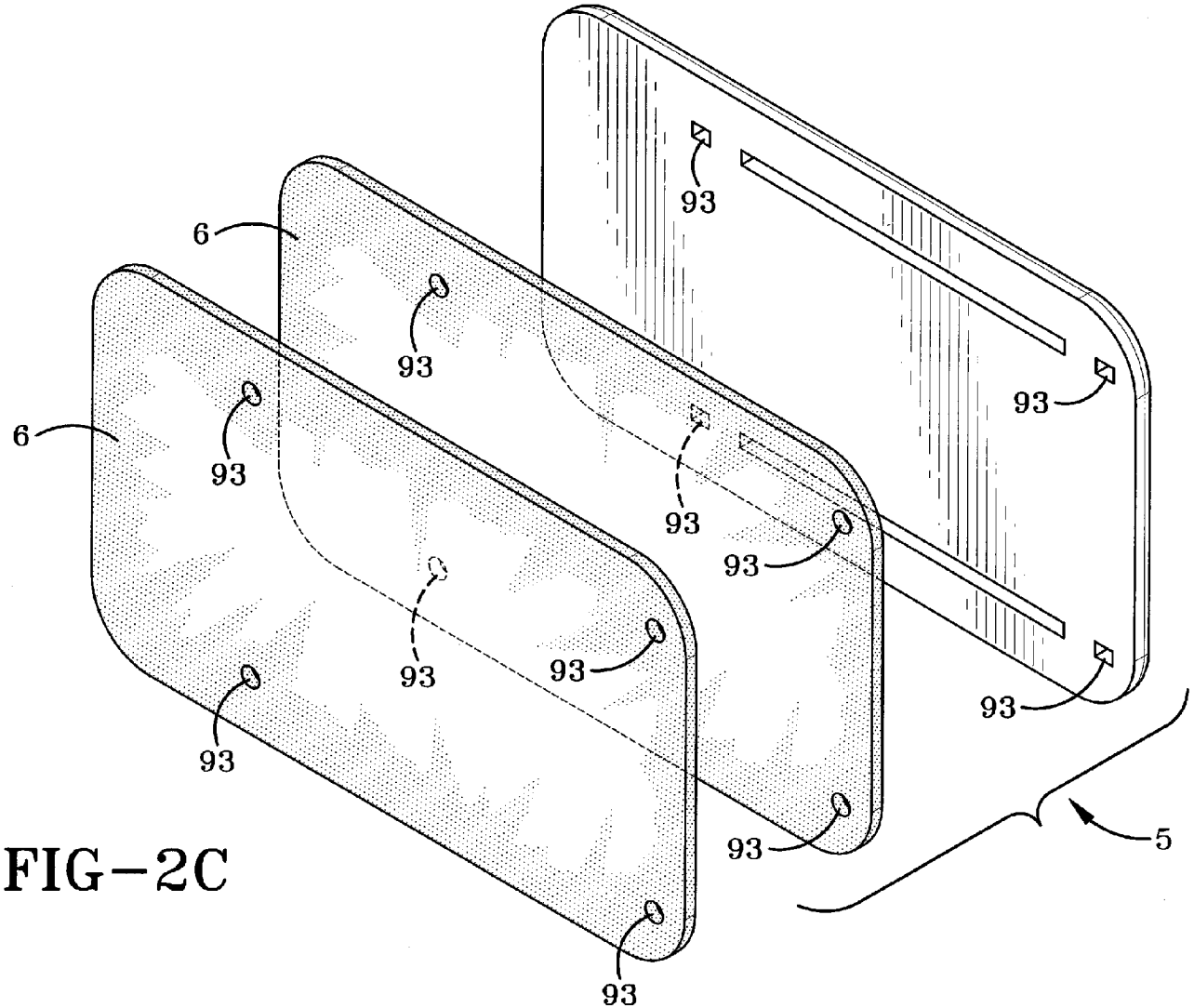
Figure 3:
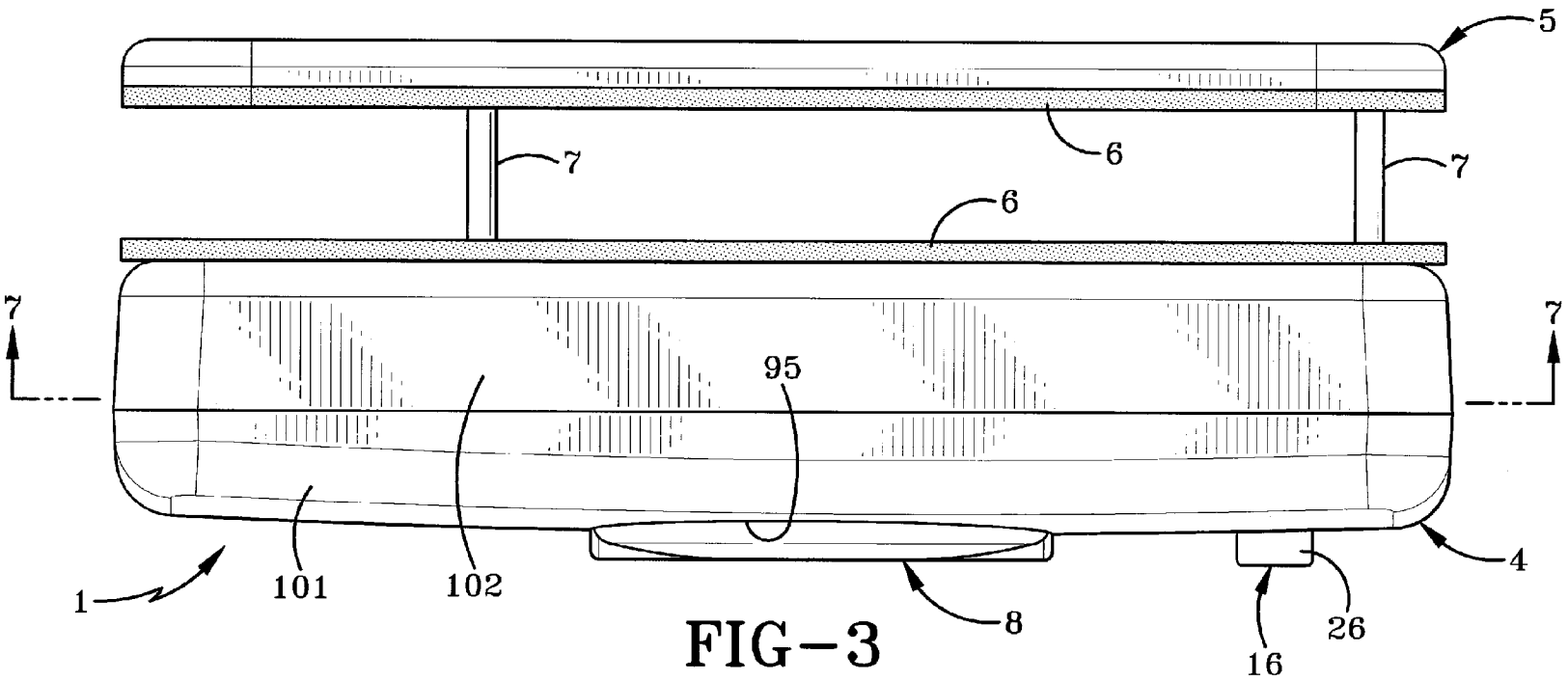
FIG. 3 is a top plan view of the preferred embodiment of the security device.
Figure 6:
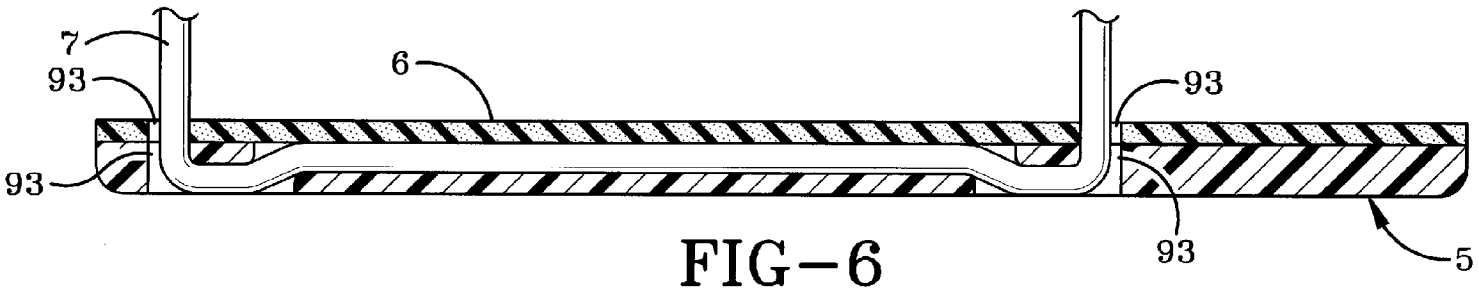
FIG. 6 is a sectional view of the rear clamping member taken on line 6-6 of FIG. 5.
Figure 4:
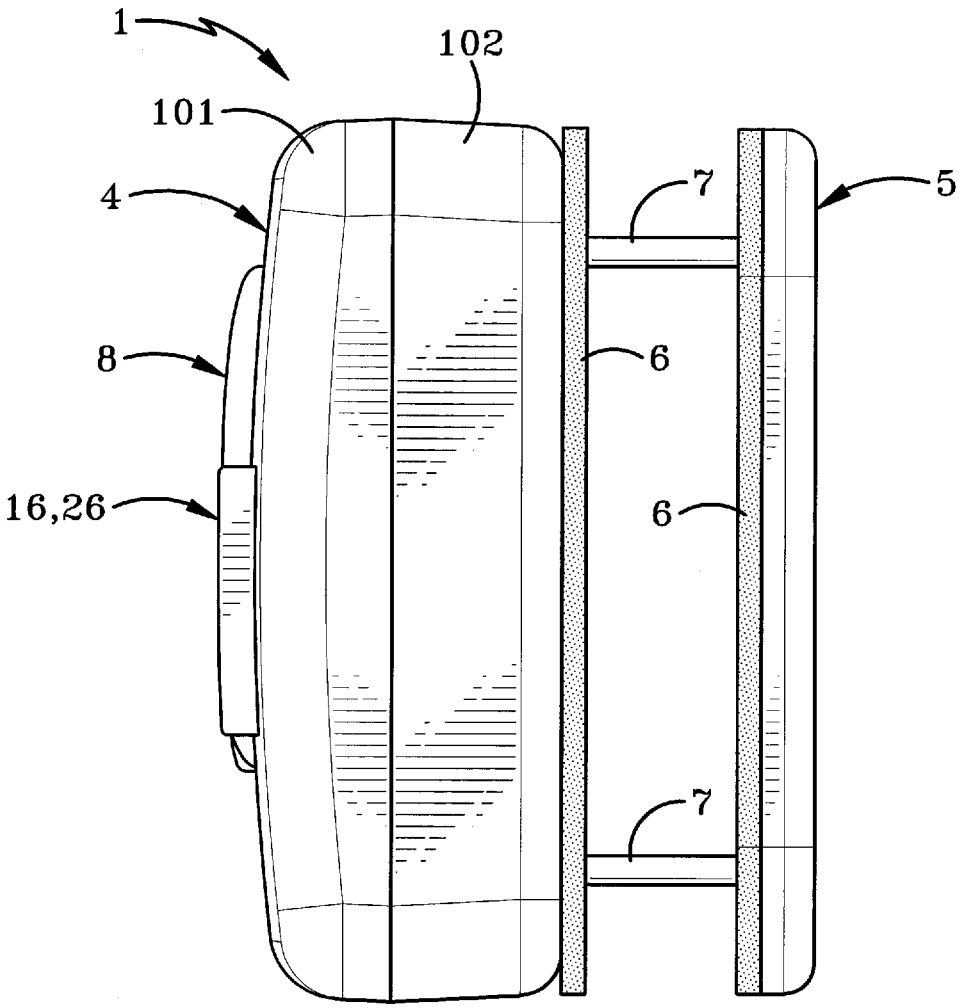
FIG. 4 is a right side elevation view of the security device.
Figure 5:
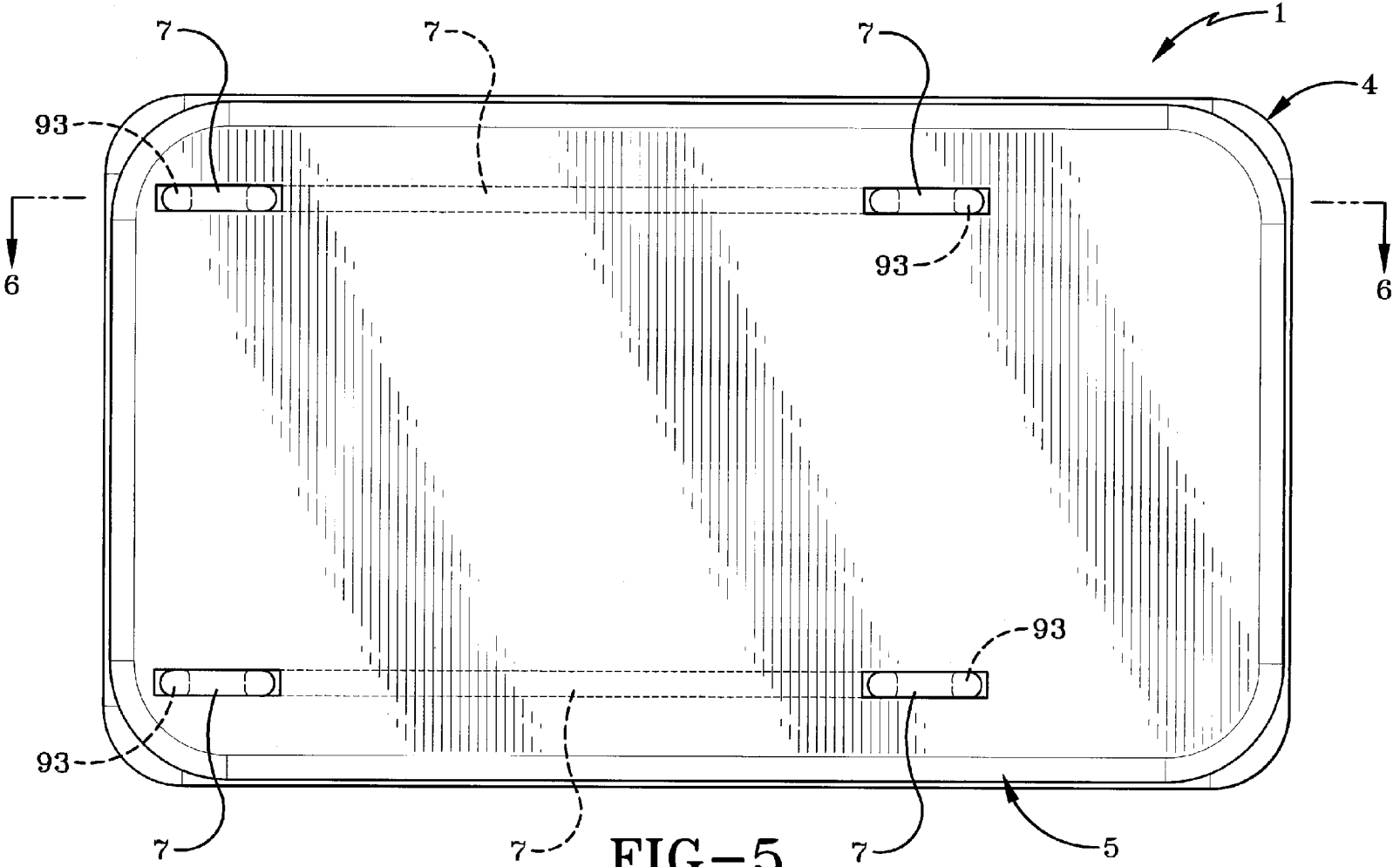
FIG. 5 is a rear elevation view of the security device.
Figure 7:
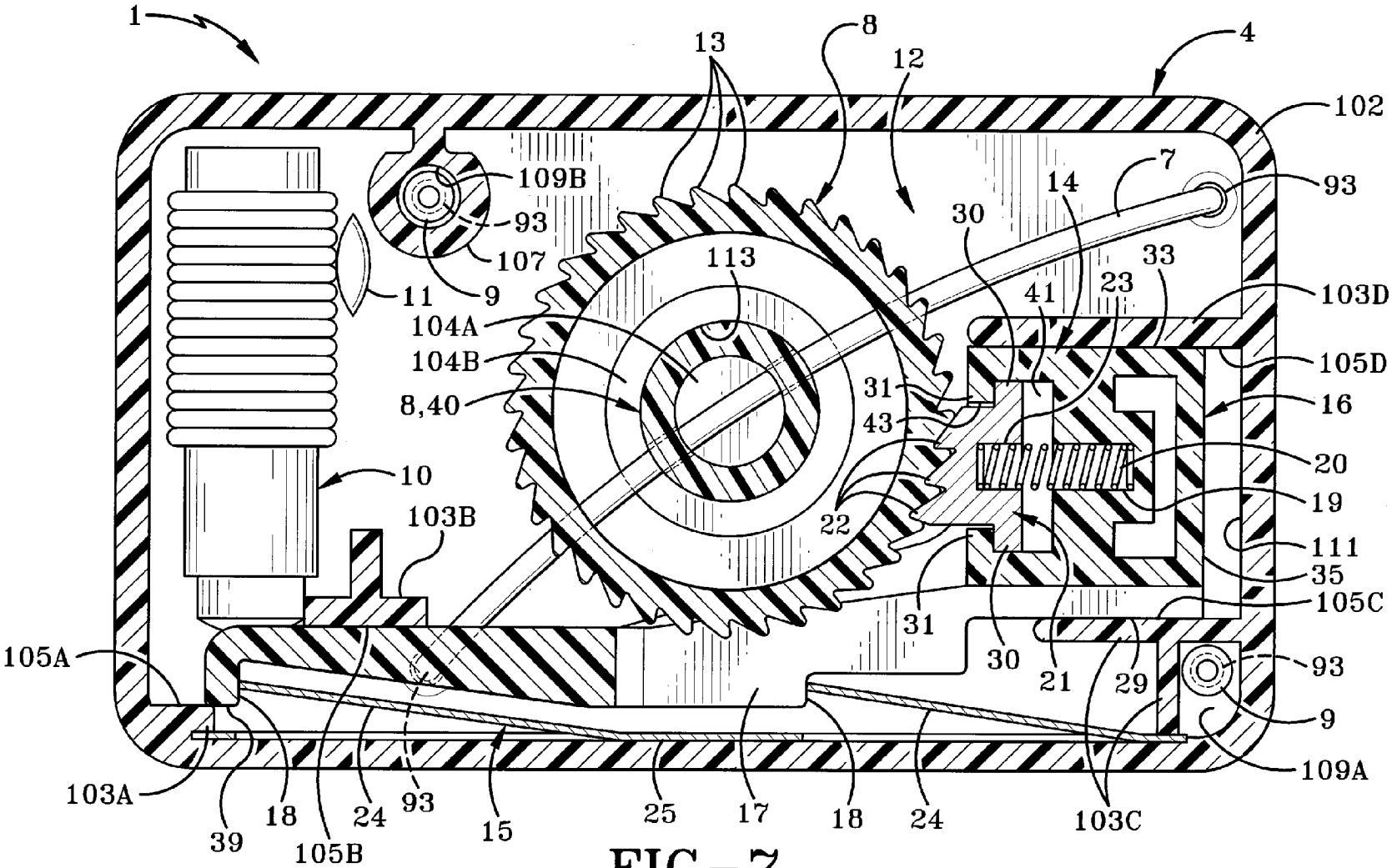
FIG. 7 is a sectional view taken on line 7-7 of FIG. 3.
Figure 9:
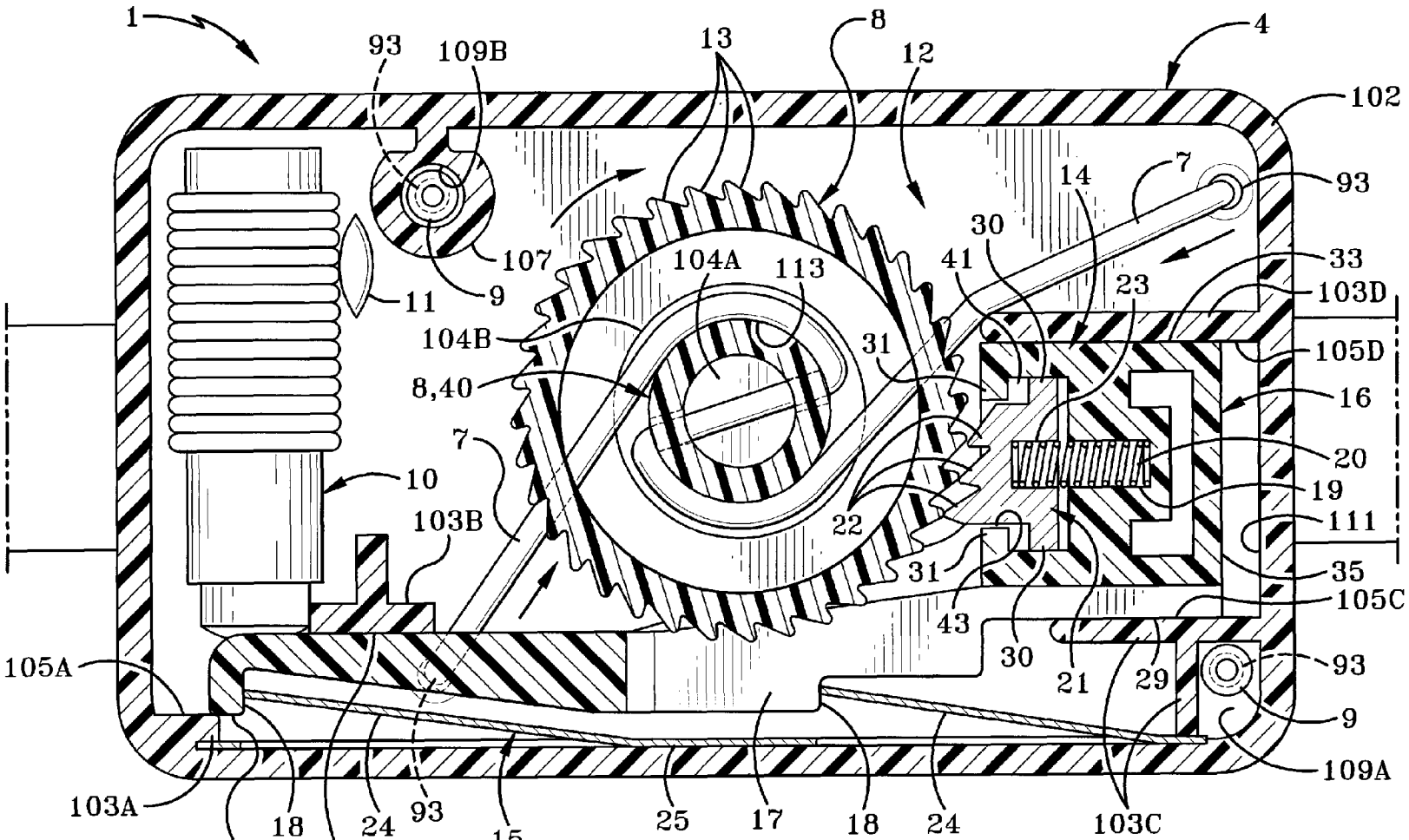
FIG. 9 is a sectional view similar to FIG. 7 showing winding of the cable onto the spool rotating with the security device in the ratcheting position.
Figure 10:
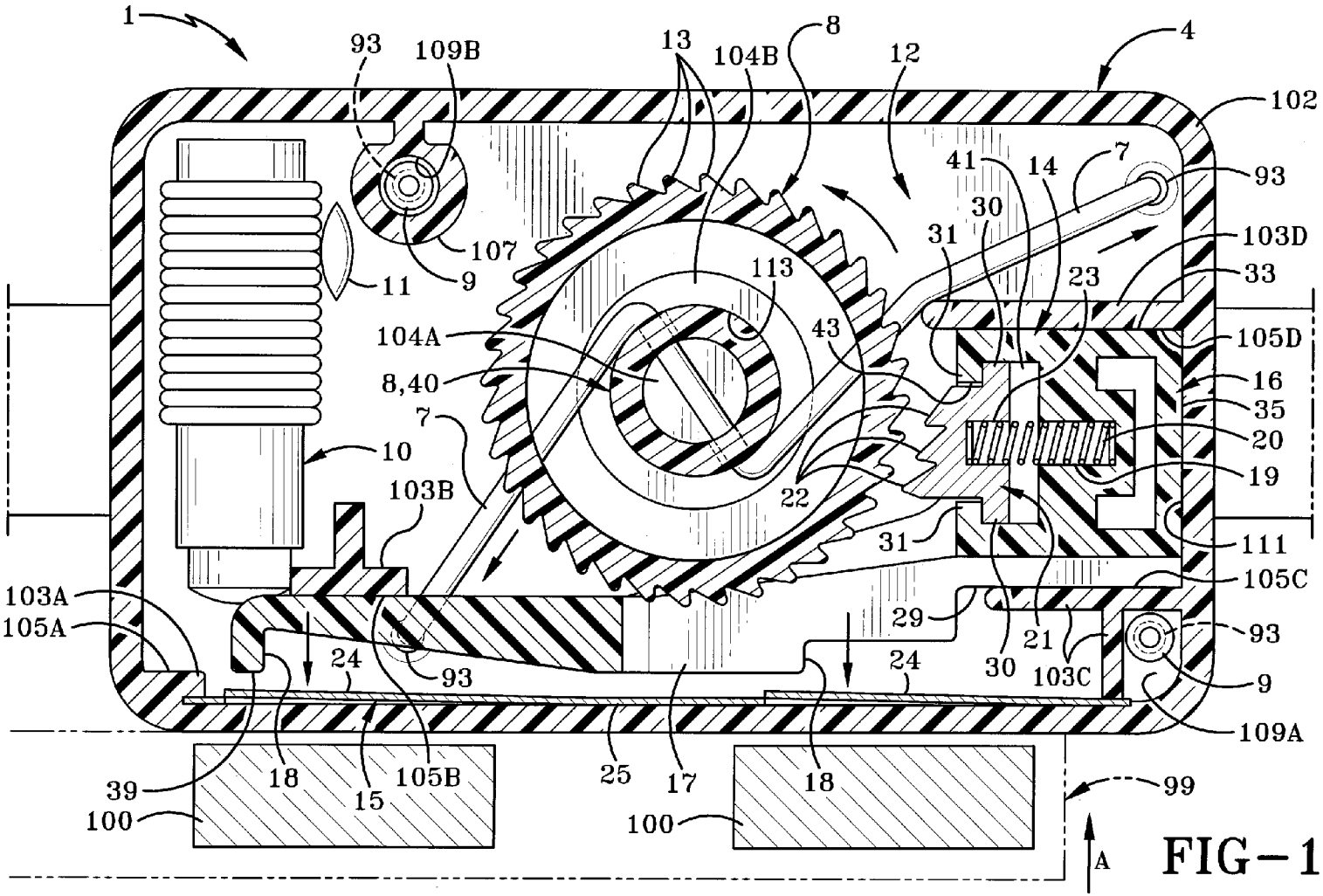
FIG. 10 is a sectional view similar to FIGS. 7 and 9 showing locking mechanism in the unlocked position, the lock slide and ratchet mechanism in the disengaged position and the spool in the freewheeling position.
Figure 11:
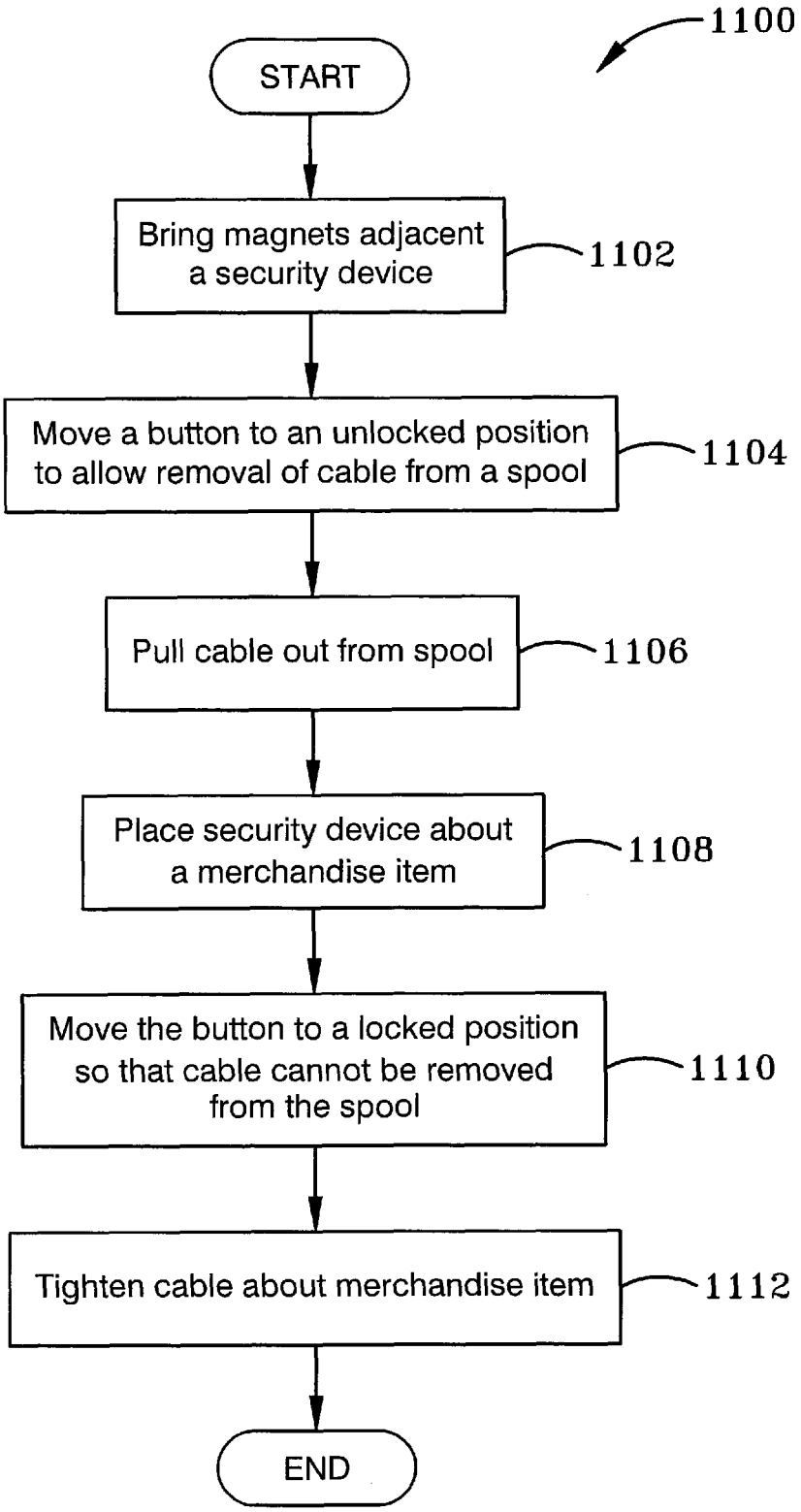
FIG. 11 is a flow chart showing a method of using the security device.

Spool 8 is typically formed of a rigid plastic material and includes a generally flat circular disc shaped portion 150 (FIG. 2A). Spool 8 further includes a plurality of ratchet teeth 13 formed around a circular outer perimeter of the circular portion 150. Teeth 13 serve as a first engaging member. Spool 8 includes an annular central wall 40 (FIG. 7) which extends rearwardly from circular portion 150 and has a smaller outer diameter than that of portion 150. Annular wall 40 is rotatably received within annular space 133 with post 104A received within a cavity defined by wall or hub 40 so that spool 8 is rotatably mounted within the interior chamber of housing 4. Annular wall 40 defines a pair of through holes (dashed lines in FIGS. 7, 9, 10) through which cable 7 passes. Spool 8 is thus configured so that cable 7 can wind onto or wrap around annular wall 104 between the circular portion 150 and the back wall of back housing member 102. A flip-up handle 28 is pivotally mounted on the front of spool 8 by a hinge pin (not numbered) whereby the user can manually engage and rotate handle 28 to rotate spool 28 in the cable winding or cable tightening direction to wind cable 7 onto spool 8 and thus take up slack in cable 7 to force clamping members 4 and 5 toward one another to a clamping position in which they clamp onto a merchandise item. In the exemplary embodiment, security tag 1 is free of a spring for automatically rotating the spool in the winding direction and winding the cable onto the spool and thus retracting the cable into the housing.

Spool 8 forms part of ratchet and locking mechanism 12, which further includes the first engaging member or ratchet teeth 13. Mechanism 12 further includes a lock slide 14 and a locking mechanism 15 which in the exemplary embodiment is in the form of a locking tine assembly for releasably locking lock slide 14. Locking mechanism 15 thus has a locked position (FIGS. 7, 9) in which tines of assembly 15 engage lock slide 14 to prevent lock slide 14 from moving from an engaged position (FIGS. 7, 9) to a disengaged position (FIG. 10) and an unlocked position (FIG. 10) in which tines 24 of assembly 15 are disengaged from lock slide 14 to allow lock slide 14 to move from the engaged position to the disengaged position and vice versa. In the disengaged position, spool 8 is in a freewheeling state and can thus be rotated in a cable winding or cable tightening direction and also rotated in a cable unwinding or cable loosening direction. In the engaged position, spool 8 can only be rotated in the cable winding or cable tightening direction and cannot be rotated in the cable unwinding or cable loosening direction.

Lock slide 14 includes a housing portion or block 16, a spring 20 and a locking portion or engaging member 21 movably mounted on block 16. Block or housing portion 16 has a horizontal downwardly facing bottom slide surface 29, a horizontal upwardly facing top slide surface 33 and a vertical rightward facing stop surface 35. Housing portion 16 defines a cavity 41 having a narrowed entrance opening 43 defined between a pair of tabs 31 which extend toward one another. A manually engageable button or finger tab 26 extends outwardly and forward from block 16. Block 16 defines a hole 19 which communicates with cavity 41 and extends away from entrance opening 43 for receiving one end of spring 20. Lock slide 14 includes an elongated arm 17 which is cantilevered from block 16 and has a shoulder 18 adjacent the free end thereof. Arm 17 adjacent the free end thereof has a horizontal upwardly facing top slide surface. A short leg 37 of lock slide 14 defines shoulder 18 and is rigidly secured to and extends downwardly from the free end of arm 17 to a tip defining a horizontal downwardly facing slide surface 39.

In the exemplary embodiment, block 16, arm 17, finger tab 26 and leg 37 are formed as a rigid one-piece lock slide body. During movement of lock slide 14 between the engaged and disengaged positions, there is a sliding engagement between slide surfaces 29 and 105C, between slide surfaces 33 and 105D, between slide surfaces 39 and 105A, and between the top slide surface of arm 17 and slide surface 105B. Stop surface 35 engages an inner stop surface 111 of the right sidewall of housing 4 in the disengaged position. In the exemplary embodiment, engaging member 21 is not spring biased to the disengaged position, the lock slide body is not spring biased to the engaged position and the lock slide body is not spring biased to the engaged position. Tag 1 typically includes no spring which extends from lock slide 14 to housing 4. Finger tab 26 typically must be manually engaged to move the lock slide from the engaged position to the disengaged position.

Engaging member or locking portion 21 has a body with a plurality of locking teeth 22 which extend outwardly from the body. The locking portion 21 body defines a hole 23 which has an entrance opening opposite teeth 22 for receiving one end of the spring 20. The locking portion 21 also includes a pair of outwardly extending tabs or stop members 30 that engage with inwardly projecting tabs or stops 31 of the block 16 to stop or limit outward movement of portion 21 and thus prevent spring 20 from pushing portion 21 out of cavity 41 of block 16. Thus, although spring 20 biases engaging member 21 toward the engaged position, outward tabs or stop members 30 of engaging member 21 engage and cannot move beyond the inward tabs or stops 31 of block 16 when lock slide 14 is in the disengaged position. Locking tine assembly 15 includes two elongated tines 24 that are formed of spring metal so that free ends of tines 24 are spring biased outward from a locking tine base 25 formed of the same piece of spring metal as tines 24. Tines 24 are magnetically attractable locking members.

EAS tag 10 is mounted inside the main housing 4. The EAS tag 10 is configured to resonate a specific frequency when it is energized by electromagnetic energy given off by a security gate or another location external to device 1 when the security device 1 is brought (by a thief) within the vicinity of the security gate. The security gate can detect the frequency resonated by the security device 1 and generate and/or sound alarms which are typically audible and/or visual. The EAS tag 10 can include one or more capacitors 11 or other electronic elements to ensure that it resonates at the desired frequency. Tag 10 may also represent an onboard internal electronic alarm configured to generate an audible and/or visual alarm if cable 7 is severed or removed from the housing 4 or configured to generate other types of alarms or to send alarm messages.

The operation and use of security device 1 will now be described. With clamping members 4 and 5 sufficiently spaced from one another, the user inserts a portion of the merchandise item between the clamping members. For instance, an elongated earpiece of eyeglasses may be positioned between the clamping members. The user may need to pull clamping members 4 and 5 apart from one another to provide such a sufficient item receiving space. If so, locking mechanism 15 must be unlocked and lock slide 14 must be in the disengaged position to place spool 8 in a freewheeling state whereby spool 8 can rotate in the unwinding or cable loosening direction. Thus, if tag 1 is in the engaged and locked positions, the user will use key 99 to unlock locking mechanism and then manually engage finger tab 26 along the front of housing 4 to slide lock slide 14 from the engaged to disengaged position. Once lock slide 14 is has been moved to the disengaged position, it typically stays in the disengaged position due solely or essentially to friction between the lock slide body and housing 4 absent a force applied to lock slide 14 via finger tab 26. Such friction exists between the slide surfaces of slide lock 14 and housing 4 discussed further above with respect to the sliding engagement therebetween.

The user may manually rotate handle 28 and spool 8 therewith to wind cable 7 onto spool 8 whether the lock slide is in the engaged or disengaged position. However, lock slide 14 must be in the engaged position in order to secure spool 8 and thus cable 7 in a tightened position and clamping members 4 and 5 in the clamping position. Thus, the user will manually engage finger tab 26 to move lock slide 14 from the disengaged to the engaged position. Locking mechanism automatically moves from the unlocked to the locked position in response to this movement of lock slide 14 due to the spring bias of tines 24 to snap up into engagement with shoulder 18 of the arm 17, thereby locking lock slide 14 in the engaged position.

Handle 28 and spool are rotated in the cable tightening direction to sufficiently wind cable 7 onto the spool 8 so that cable 7 is tightened about the merchandise item and clamping members 4 and 5 are forced into a clamping engagement with the merchandise item (and with one other especially if the item is relatively small) to secure tag 1 to the merchandise item. The substantial surface area of the front and rear clamping members 4 and 5 distributes over a substantial area the force which secures security tag 1 to the merchandise item. As cable 7 is tightened, engaging member or ratchet teeth 22 of lock slide 14 ratchet over ratchet teeth 13 of spool 8. Spring 20 biases locking portion 21 relative to block 16 into contact with locking teeth 13 of the spool 8 in the engaged position. This spring bias combined with the triangular shape of both sets of one-way ratchet teeth only permit the spool 8 to be rotated in the cable tightening direction but not rotated in the cable loosening direction.

Once security device 1 is attached to the merchandise item, the item may safely be placed on display. If one were to try to carry the protected merchandise item through an EAS security gate, the EAS tag in the security device 1 would resonate a frequency, as discussed earlier, and the security gate would detect that frequency and generate one or more alarms. Store security and/or personnel would then be alerted to take proper action.

When the merchandise item is properly purchased, store personnel can position (arrow A in FIG. 10) a magnetic key 99 with one or more magnets 100 adjacent the bottom side of housing or body 4 adjacent the magnetically attractable members or tines 24. Magnets 100 of magnetic key 99 magnetically attract tines 24 to cause tines 24 to disengage from shoulders 18 of lock slide 14, thereby moving locking mechanism 15 from the locked to the unlocked position. When security tag 1 is unlocked, the user manually engages and pushes finger tab 26 from left to right within opening 97 to move lock slide 14 from the engaged position to the disengaged position to place spool 8 in a freewheeling position or state so that cable 7 can be unwound from spool 8 and front and rear clamping members 4 and 5 can be pulled apart from the clamped position in which the clamping members clamp the merchandise item to an unclamped position so that the security device 1 can be quickly and easily removed from the item.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

FIG. 14 illustrates a method 1100 of attaching a security device to a merchandise item that spreads out pressure of attachment when the security device is attached to merchandise item. The security device includes a cable attached to a housing/clamping member and a crossover device/clamping member. The method 1100 begins by bringing a magnetic lock adjacent the security device, at 1102, to unlock the security device. Next, a button or lock slide is moved to an unlocked position to allow cable to be removed from a spool in the security device, at 1104. Now, cable can be pulled out from a spool, at 1106, allowing a cable crossover device (one clamping member) and main housing (another clamping member) to be pulled apart or away from one another. The security device can now be placed about the merchandise item, at 1108, with a portion of the item in a merchandise receiving space between the clamping members.

The button or slide lock with its engaging member can then be moved to an engaged position and a locked position, at 1110, that moves locking teeth into ratcheting contact with complementary ratchet teeth on the spool in a ratcheting position. The cable can then be tightened, at 1112, by rotating the spool to wind the cable thereon, thereby causing the clamping members to move toward one another to a clamping position to clamp at least a portion of the merchandise item therebetween to secure the security tag to the merchandise item. The crossover device (one of the clamping members) may be slightly flexible or bendable to flex or bend around the merchandise item to partially conform to a given shape of the merchandise item to more securely attach the security tag to that item. An onboard or remote alarm is provided which will be activated to generate an alarm which is typically audible and/or visual upon movement of the security tag from a non-alarming zone to an alarming zone, such as by moving the security tag to within a predetermined distance from a security gate. An alarm may also be generated, for example, when the cable is compromised, such as when a potential thief cuts the cable or otherwise tampers with tag 1.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the descriptions and illustrations of the various embodiments are examples and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

The invention claimed is:

1. A security device comprising:

a housing having a front housing surface and a back housing surface;

a cable;

a spool which is within the housing and rotatable in a winding direction for winding the cable onto the spool and an unwinding direction for unwinding the cable from the spool;

a block having a bottom slide surface, a top slide surface, and a plurality of tabs, wherein the block defines a cavity having an entrance defined between the plurality of tabs;

a lock slide which is movable between an engaged position and a disengaged position and comprises a lock slide body;

a locking portion having a body with a plurality of locking teeth, wherein the locking portion defines a hole opposite the locking teeth, wherein the locking portion further includes stop members configured to engage with at least one of the plurality of tabs of the block; and a spring extending through the hole.

2. The security device of claim 1, further comprising:

compressible pads formed of an elastomer; and a manually engageable button extending outwardly from the block.

3. The security device of claim 2, wherein the lock slide body is not spring biased to the disengaged position.

4. The security device of claim 1 wherein the housing defines a through opening; and the lock slide body comprises a finger tab within the through opening and externally accessible for manual engagement and movement of the lock slide.

5. The security device of claim 4 wherein the finger tab permits manual movement of the lock slide from the engaged position to the disengaged position.

6. The security device of claim 1 wherein the locking mechanism moves from the unlocked position to the locked position in response to movement of the slide lock from the disengaged position to the engaged position.

7. The security device of claim 1 wherein the locking mechanism is spring biased to the locked position.

8. The security device of claim 1 wherein the locking mechanism moves from the locked position to the unlocked position in response to a magnet positioned adjacent the locking mechanism.

9. The security device of claim 1 wherein the housing defines first and second through holes; the cable extends from the spool out of the housing through the first through hole and back into the housing through the second through hole to a first end which is permanently secured within the housing so that no portion of the cable which extends into the housing from the second through hole engages the spool.

10. The security device of claim 1 further comprising a first through hole formed in the housing; a compressible pad outside the housing; a second through hole formed in the pad; wherein the cable extends from the spool through the first and second through holes.

11. The security device of claim 1 wherein the housing serves as a first clamping member; further comprising a second clamping member positioned so that the first and second clamping members define therebetween an item receiving space adapted to receive a portion of a merchandise item; wherein the second clamping member moves toward the first clamping member in response to the cable winding onto the spool so that the first and second clamping members are configured to clamp therebetween the portion of the merchandise item.

12. The security device of claim 11 wherein one of the clamping members is bendable under force applied by the cable to allow the bendable clamping member to bend around the merchandise item when the merchandise is clamped between the clamping members.

13. The security device of claim 11 further comprising a first compressible pad which is between the clamping members and adapted to engage the merchandise item when the clamping members are in a clamped position.

14. The security device of claim 13 further comprising a second compressible pad which is between the clamping members and adapted to engage the merchandise item when the clamping members are in the clamped position.

15. The security device of claim 1, wherein the plurality of tabs extend toward one another.

16. The security device of claim 1, wherein the locking portion is movably mounted on the block.

17. A security device comprising:

a rotatable spool;

an EAS tag;

a block having a bottom surface, a top surface, and at least two tabs, wherein a cavity is defined within the block;

a locking portion having a body with a plurality of locking teeth, wherein the locking portion defines a hole opposite the locking teeth, wherein the locking portion further includes stop members configured to engage with at least one of the at least two tabs; and a spring extending through the hole.

18. The security device of claim 17, further comprising:

compressible pads formed of an elastomer; and a manually engageable button extending outwardly from the block.

19. The security device of claim 17, wherein the housing defines a through opening; and the lock slide body comprises a finger tab within the through opening and externally accessible for manual engagement and movement of the lock slide.

20. The security device of claim 19, wherein the finger tab permits manual movement of the lock slide from the engaged position to the disengaged position.

* * * * *